US005221196A

United States Patent [19]

Harbig et al.

[11] Patent Number: 5,221,196

[45] Date of Patent: Jun. 22, 1993

[54] FUEL INJECTION PUMP FOR INTERNAL COMBUSTION ENGINES

[75] Inventors: Bernd Harbig, Ditzingen; Wolfgang Eckell, Leonberg; Gottfried Kuehne, Erdmannshausen; Johann Warga, Bietigheim-Bissingen; Theodor Stipek, Salzburg; Heinz Lauterbach, Esslingen, all of Fed. Rep. of Germany

[73] Assignee: Robert Bosch GmbH, Stuttgart, Fed. Rep. of Germany

[21] Appl. No.: 845,576

[22] Filed: Mar. 4, 1992

[30] Foreign Application Priority Data

Sep. 30, 1991 [DE] Fed. Rep. of Germany ..... 4132505

[51] Int. Cl.[5] ..... F02M 59/26; F02M 59/44

[52] U.S. Cl. ..... 417/499

[58] Field of Search ..... 417/494, 499; 123/500, 123/501, 503

[56] References Cited

U.S. PATENT DOCUMENTS 2,101,221 12/1937 L'Orange ..... 417/494
4,830,587 5/1989 Guentert et al. .
4,913,633 4/1990 Kraemer et al. ..... 417/499

FOREIGN PATENT DOCUMENTS 2107802 5/1983 United Kingdom ..... 417/494
2231369A 11/1990 United Kingdom .

*Primary Examiner*—Richard E. Gluck
*Attorney, Agent, or Firm*—Edwin E. Greigg; Ronald E. Greigg

[57] ABSTRACT

A fuel injection pump for internal combustion engines having a reciprocating pump piston and an annular slide displaceable on it, with a control bore that cooperates with a control recess on the pump piston, the recess communicates with a pump work chamber via a conduit. By means of location of control bores in the annular slide, the outflow stream is provided with the longest possible path until the outflow stream strikes the wall of the cylinder liner, in order to attain the freest and most unhindered possible stream course with reduced turbulence. Because the outflow stream strikes the hardened surface of the niche wall of the cylinder liner obliquely, cavitation damage is greatly attenuated or locally limited to sites of maximum resistance.

28 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines. Such a fuel injection pump is known from U.S. Pat. No. 4,830,587. There, both the onset and end of supply are regulated via an annular slide that is displaceable on the pump piston; one face edge of the annular slide controls the supply onset as the control recess of the pump piston enters the annular slide, and along with the control edge of the oblique groove oriented toward the pump work chamber, a radial control bore disposed in the annular slide controls the end of supply. Particularly in fuel injection pumps that operate at high injection pressure, upon closing and opening of the control bores, voids in the fuel (vapor bubbles) form as the fuel flows out of the pump work chamber into the suction chamber of the fuel injection pump surrounding the control slide; because of the inertia of the fuel, these voids cause areas of negative pressure in the fuel flow, and at the moment that happens, the fuel pressure drops below the vapor pressure. Some of the vapor bubbles are reaspirated into the control bores from the fuel injection pump suction chamber during the intake stroke of the pump piston. They are entrained by the flow and implode upon contact with a solid wall. As a result, a spike of liquid at maximum energy (high-charge effect) briefly forms, which can remove material from the wall and cause subsequent damage (cavitation) to the fuel injection pump. Avoiding or limiting the aforementioned cavitation damage is thus a necessity, for the sake of safe operation over the full service life of even fuel injection pumps that operate at a very high fuel pressure.

OBJECT AND SUMMARY OF THE INVENTION

The fuel injection pump according to the invention has an advantage over the prior art that cavitation damage is avoided, or at least locally limited to the most resistant sites, such as pump parts with a hardened surface. To this end, a return flow of vapor bubbles, which is created by the sharp pressure drop in the narrowest cross section of the outflow gap between the control bore and the control edge, controlling this gap, of the control recess from the suction chamber into the control bore, is avoided, and an unhindered outflow stream in its natural stream direction is made possible; the longest possible path for the outflow stream is afforded until it strikes the niche wall of the cylinder liner. This is attained by means of a spatially oblique disposition of the control bores in the annular slide, which assures an outflow stream that is free over a spatially long distance until it strikes a wall of the fuel injection pump after it exits the annular slide. The outflow stream, which widens in its natural stream direction, also reinforces the pressure relief process in the high-pressure chamber, because the diverted fuel can flow out unhindered; the pump work chamber and the injection line can be pressure relieved quickly, and the injection valve can be closed faster. Because of the uniform outflow of fuel at the annular slide, a laminar fuel flow occurs, as a result of which turbulence that would cause an increased fuel flow resistance or the flushing of the vapor bubbles against the housing wall, can be avoided. To prevent the outflow stream from striking the suction chamber wall or to prevent the implosion of vapor bubbles in the housing element bore, which is made of an aluminum alloy, the control bores are rotated out of their central position, tilted out of the radial plane of the pump piston, and their axis are offset from one another in the radial plane of the pump piston. An outflow stream that spreads out unhindered is thus possible and assures that the outflowing fuel will strike only the cylinder liner niche wall, which is of hardened steel, and that the remaining effects of cavitation will be limited to that region.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
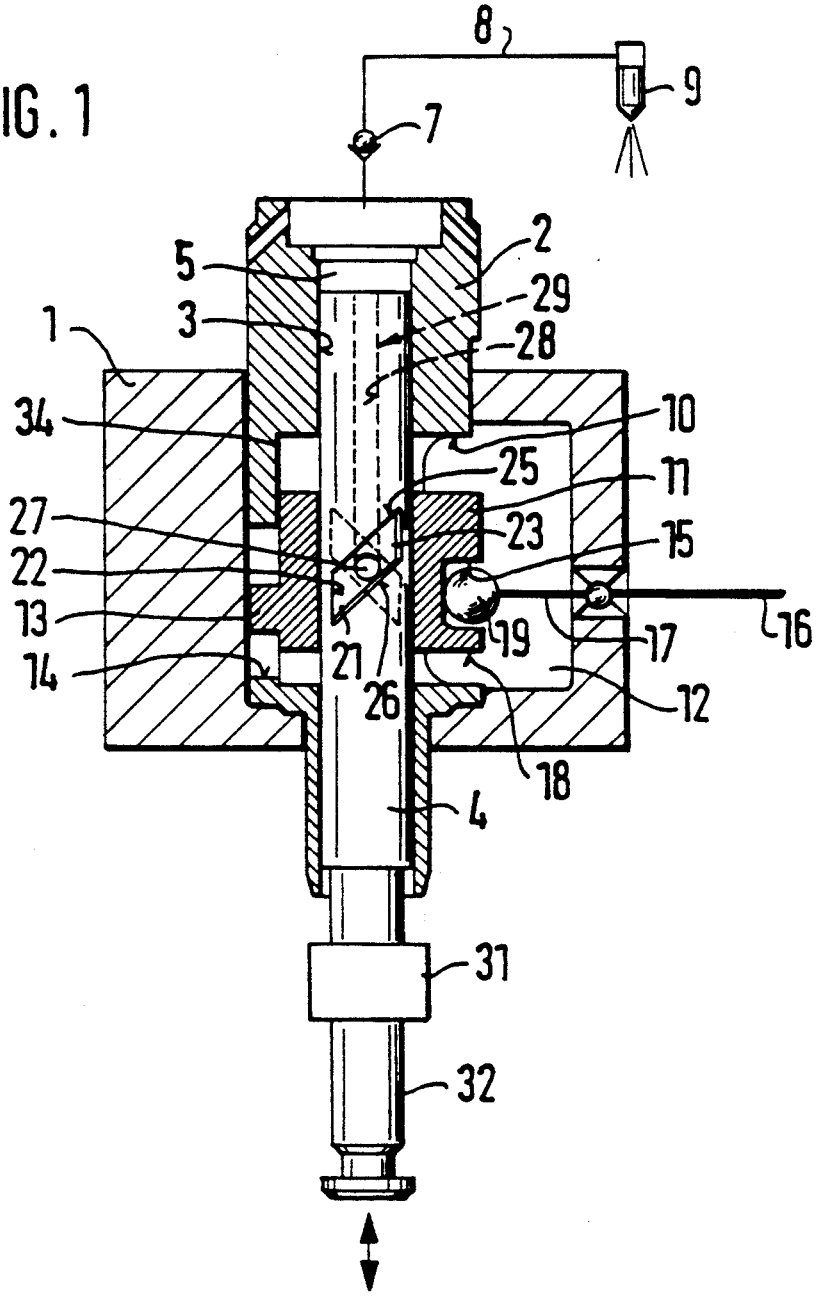
FIG. 1 shows part of a fuel injection pump in longitudinal section.
Figure 4:
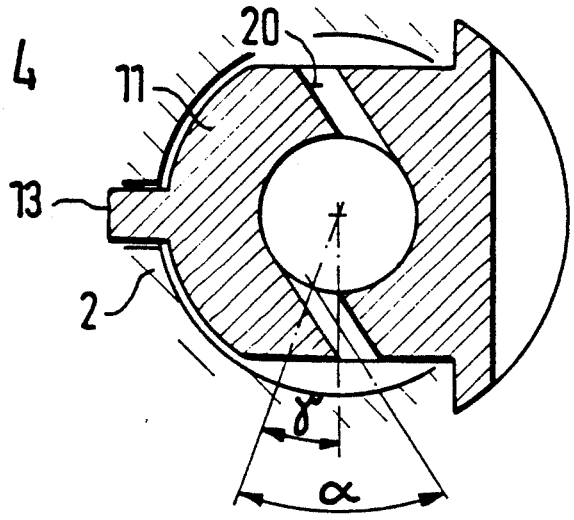
FIG. 4 shows a further exemplary embodiment similar to FIG. 3, in which the control bores are rotated by a larger angle than in FIG. 3.

FIG. 1 shows the portion of a known fuel injection pump that has been improved according to the invention. A cylinder liner 2 with a cylinder bore 3 is inserted into a pump housing 1, and a pump piston 4, axially moved by a camshaft, not shown, is displaceable in the cylinder bore, enclosing in the cylinder bore a pump work chamber 5. The pump work chamber 5 communicates with an injection valve 9 via an injection line 8 containing a pressure valve 7. The cylinder liner 2 has a cylindrical recess 10, which is open laterally to a low-pressure chamber 12 and thus in shell-like fashion surrounds an annular slide 11 that is displaceable axially on the pump piston inside the recess 10. Via a rib 13 protruding radially from the circumference of the annular slide, this annular slide 11 engages a longitudinal groove 14 of the cylinder liner 2 in the region of the recess 10 and is thus secured against twisting as shown in FIG. 4. The annular slide 11 also has a lower face edge 18 and a recess 15 made in its circumference, the recess being engaged by a two-armed lever 16, supported in a manner structurally connected to the housing, with a ball head 19 located on one arm 17, so that the annular slide 11 can be displaced axially on the pump piston 4. The annular slide 11 also has two diametrically opposed, radially extending control bores 20 (FIG. 2), with which two oblique grooves 22, machined axially symmetrically into the jacket or circumferential face of the pump piston 4 are associated which serve to control the recesses 21; these grooves extend at a predetermined angle with respect to the longitudinal axis of the pump piston 4 and have a flat groove bottom 23 and two parallel-extending oblique control edges, of which an upper control edge 25 is closer to the pump work chamber 5 and the other, lower control edge 26 is more remote from the pump work chamber 5. The groove bottom 23 is spaced apart from the pump piston axis by the same distance at every point. In the middle of the bottom 23 of the oblique grooves 22, a transverse bore 27 radially penetrates the pump piston 4 to communicate with a longitudinal axial blind bore 28. The blind bore begins at the pump work chamber 5 and extends axially in the pump piston 4, discharges into the transverse bore 27 and forms a conduit 29 between the control recesses 21 and the pump work chamber 5. The pump piston 4 is guided in a manner fixed against twisting by a guide face 31 on a part 32 protruding from the cylinder liner 2 by any means well known in the prior art which also functions to rotate the piston in order to control the injection quantity; the oblique grooves 22 and the control bores 20 are located on both sides of a plane of symmetry 33, which receives the pump piston axis and passes through the center of the longitudinal groove 14 of the cylinder liner 2, of the recess 10 of the cylinder line 2, this recess forming a diameter of expansion 34.

Figure 2:
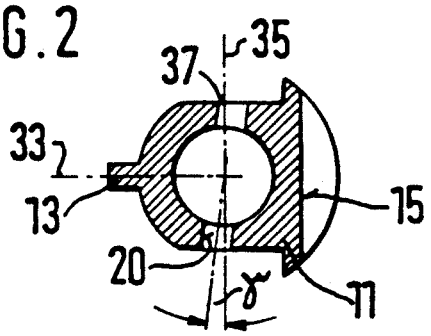
FIG. 2 is a section through the annular slide of a first exemplary embodiment taken along the center axis of the control bores, which are rotated from their originally rectangular position to a plane of symmetry of the annular slide, the pump piston axis being located in that plane of symmetry.

In FIG. 2, which is a section through the annular slide 11 along the control bores 20 of the first exemplary embodiment, the location according to the invention of the control bores 20 in the annular slide 11 is shown. The control bores 20 have a common axis, which is located in the radial plane of the pump piston axis and is rotated about a predetermined angle (gamma) from its originally rectangular location with respect to the plane of symmetry 33 of the diameter expansion 34. The axes of the control bores 20 intersect the pump piston axis, and their outlet openings 37 from the annular slide 11 are located, offset, on both sides of a reference plane 35 that receives the pump piston axis; the reference plane intersects the plane of symmetry 33, receiving the pump piston axis, of the diameter expansion 34 in the pump piston axis at right angles.

Figure 3:
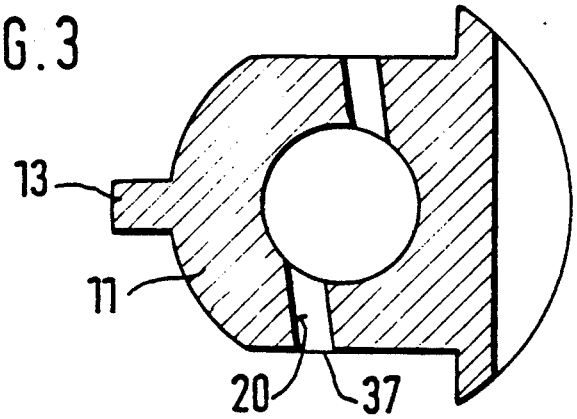
FIG. 3 is a section through the annular slide of a second exemplary embodiment along the center axes of the now rotated and offset control bores.

FIG. 3 shows a second exemplary embodiment in a view similar to FIG. 2. Here, as in the exemplary embodiment described in conjunction with FIG. 2, the control bores 20 are rotated out of their original location, and in addition to that, they are offset from one another and from the reference plane 35; the axis of the control bores 20 on the side of the offset of their exit 37 from the annular slide 11 extend in the direction of the low-pressure chamber 12 next to the pump piston axis with respect to the reference plane 35.

The third exemplary embodiment, shown in FIG. 4 in a view similar to FIGS. 2 and 3, differs from that shown in FIG. 3 solely in the larger rotational angle by which the control bores 20 are rotated out of the reference plane 35, as a result of which the axis of the control bore 20 extend not on the side of the offset of their exit 37 but rather on the opposite side of the reference plane 35, next to the pump piston axis. The control bores 20, rotated out of the normal position, are advantageously offset as far as possible with respect to the reference plane 35 and lead away from the inner bore 39 of the annular slide 11 approximately at a tangent, in order to assure that the outflow stream emerging from the control bores 20 will strike the hardened wall of the cylinder liner 2 despite the longest possible path of the outflow stream until it strikes the wall of the cylinder liner 2.

Figure 5:
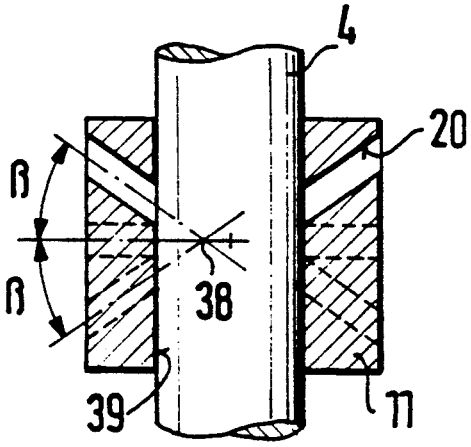
FIG. 5 is a schematic view of the various courses of the control bores, which can be applied to FIGS. 2–4, in a plane that receives the pump piston axis.

FIG. 5 shows three variants of different courses, which can be employed with FIGS. 2–4, of the control bores 20 in the annular slide 11 with respect to a plane that receives the pump piston axis. Next to a location disposed in the radial plane of the pump piston 4, the control bores 20 are rotated in both directions about a point 38 through which the axis of the control bores 20 pass through the inner wall 39 of the annular slide 11, out of the radial plane of the pump piston 4, by a predetermined angle ($\beta$); their axes intersect in the pump piston axis.

The fuel injection pump according to the invention functions as follows:

If the pump piston is in its bottom dead center position, the control recesses 21 are uncovered, so that the fuel can flow out of the low-pressure chamber 12 into the pump work chamber 5 via the conduit 29. During the supply stroke of the pump piston 4, the lower control edge 26 of the control recess 21 of the pump piston 4 enters the annular slide 11. As soon as this control edge 26 has moved past the lower face edge 18 of the annular slide 11 and thereby closes the conduit 29 connecting the pump work chamber 5 to the low-pressure chamber 12, the pressure necessary for injection can build up in the pump work chamber 5; the pressure valve 7 is pushed open, and the injection begins via the injection valve 9. This high-pressure supply continues until such time as the upper control edge 25 of the control recess 21 reaches the control bores 20 in the annular slide 11, and the fuel, which is at high pressure, flows via this opening cross section out of the pump work chamber 5 and the conduit 29, so that the pressure valve 7 closes again in response to this pressure drop, and the injection of the injection valve 9 is ended.

As the supply stroke of the pump piston 4 continues up to its top dead center position, the fuel continues to flow out of the pump work chamber 5 via the conduit 29, the control recesses 21 and the control bores 20, back into the low-pressure chamber 12. The instant of high-pressure supply is determined by the axial location of the annular slide 11 on the pump piston 4, while the rotational location of the pump piston 4 relative to the annular slide 11 regulates the required fuel quantity, via the oblique grooves 22. Compared with a rectangular location of the control bores 20 with respect to the plane of symmetry 33, as provided in known fuel injection pumps, which because of the short path of the outflow stream out of the control bore 20 until it strikes the wall of the cylinder liner 2 causes cavitation damage to the wall of the cylinder liner 2, and because of the geometry of the oblique grooves 22 to the control bores 20, causes damage at the pump housing 1 bordering the cylinder liner as well, the fuel injection pump according to the invention has the advantage that because of the location according to the invention of the control bores 20 in the annular slide 11, cavitation damage to the pump housing 1 and cylinder liner 2 caused by fuel emerging from the control bores 20 at high pressure can be reduced as shown in FIG. 4. This avoids the danger both of the formation of voids in the fuel caused by a drop of the fuel pressure to below the vapor pressure, and of the possible implosion of these voids at the housing wall 1. Because of the long path of the outflow stream emerging from the control bores 20 and its arrival at the wall of the cylinder liner 2 at a tangent, the voids in the fuel are additionally flushed away from threatened wall parts, and a return flow of the voids from the low-pressure chamber 12 is prevented. This makes it possible to reduce cavitation phenomena, or to locally limit the focus of unavoidable cavitation damage to regions of components made of materials with high cavitation resistance.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having at least one pump piston (4), that reciprocates in a cylinder bore (3) of a cylinder liner (2) inserted into a housing (1) of the fuel injection pump, the pump piston defining a pump work chamber (5) and on a circumferential face the pump piston has at least two control recesses (21) diametrically opposite one another which communicates with the pump work chamber (5) through radial bores (27) and a conduit (29), the recesses having an oblique control edge (25, 26) extending at a predetermined angle from the axis of the pump piston (4), an annular slide (11) is adjustable on the pump piston (4) inside a cylindrical recess (34) in said cylinder liner and is surrounded by a fuel-filled low-pressure chamber (12), the annular slide having control bores (20) which penetrate the wall of the annular slide and each control bore is associated with one of the control recesses (21), the control bores being openable by the oblique control edges (25, 26) in the course of the pump piston stroke, said cylindrical recess (34) is formed by a diameter enlargement of the cylinder bore (3) in the cylinder (2), the diameter enlargement forming a part of the low-pressure chamber (12), with a lateral opening transversely of the pump piston axis, by way of which opening the diameter enlargement communicates with another part of the low-pressure chamber (12), and having a disposition of the annular slide (11) inside the diameter enlargement, which in shell-like fashion encompass part of the annular slide (11), the control bores (20) include exits (37) disposed diametrically opposite one another which discharge into said substantially circular cylindrical recess which then flows into the low-pressure chamber, each of said bore exits (37) exits on one of two sides of and offset from a reference plane (35) through the pump piston axis, wherein the reference plane (35) intersects the plane of symmetry (33) at right angles and at a right angle to the pump piston axis.

2. A fuel injection pump as defined by claim 1, in which the offset of the exits (37) of each bore takes place in a direction of rotation in which an acute angle ($\delta$) formed between a radial plane of the pump piston (4) and the oblique control edges (25, 26) are directed.

3. A fuel injection pump as defined by claim 1, in which the control bores (20) have a common axis, which intersects the pump piston axis.

4. A fuel injection pump as defined by claim 2, in which the control bores (20) have a common axis, which intersects the pump piston axis.

5. A fuel injection pump as defined by claim 1, in which the axes of the control bores (20) are located in a common plane through the pump piston axis, and in the common plane the axes intersect one another at an acute angle 2 ($\beta$) relative to the pump piston axis.

6. A fuel injection pump as defined by claim 2, in which the axes of the control bores (20) are located in a common plane through the pump piston axis, and in the common plane the axes intersect one another at an acute angle 2 ($\beta$) relative to the pump piston axis.

7. A fuel injection pump as defined by claim 5, in which the axes of the control bores extend such that they rise, preferably in a direction of the pump work chamber (5).

8. A fuel injection pump as defined by claim 6, in which the axes of the control bores extend such that they rise, preferably in a direction of the pump work chamber (5).

9. A fuel injection pump as defined by claim 1, in which the axes of the control bores (20) are located next to the pump piston axis.

10. A fuel injection pump as defined by claim 2, in which the axes of the control bores (20) are located next to the pump piston axis.

11. A fuel injection pump as defined by claim 9, in which the axes of the control bores (20) intersect the radial plane of the pump piston axis at a predetermined angle ($\beta$) of intersection.

12. A fuel injection pump as defined by claim 10, in which the axes of the control bores (20) intersect the radial plane of the pump piston axis at a predetermined angle ($\beta$) of intersection.

13. A fuel injection pump as defined by claim 9, in which the axes of the control bores extend such that they rise, in a direction of the pump work chamber (5).

14. A fuel injection pump as defined by claim 11, in which the axes of the control bores extend such that they rise, in a direction of the pump work chamber (5).

15. A fuel injection pump as defined by claim 9, in which the axes of the control bores (20), on the side of an offset of their exit (37), extend next to the pump piston axis with respect to the reference plane (35).

16. A fuel injection pump as defined by claim 7, in which the angles ($\beta$) of intersection of the axes of the control bores (20) are of equal magnitude.

17. A fuel injection pump as defined by claim 9, in which the angles ($\beta$) of intersection of the axes of the control bores (20) are of equal magnitude.

18. A fuel injection pump as defined by claim 11, in which the angles ($\beta$) of intersection of the axes of the control bores (20) are of equal magnitude.

19. A fuel injection pump as defined by claim 13, in which the angles ($\beta$) of intersection of the axes of the control bores (20) are of equal magnitude.

20. A fuel injection pump as defined by claim 11, in which the angle ($\beta$) of intersection of the axes of the control bores (20) through the radial plane of the pump piston (4) is preferably from $+10°$ to $+30°$ or $-10°$ to $-30°$, respectively.

21. A fuel injection pump as defined by claim 9, in which the axes of the control bores (20) intersect a line from the axis of the pump piston through an axis of an elliptical opening of the control bore along the inner wall (39) of the annular slide (11) in which a projection on the radial plane of the pump piston axis at an angle ($\alpha$) is of from 6° to 30°.

22. A fuel injection pump as defined by claim 11, in which the axes of the control bores (20) intersect a line from the axis of the pump piston through an axis of an elliptical opening of the control bore along the inner wall (39) of the annular slide (11) in which a projection on the radial plane of the pump piston axis at an angle ($\alpha$) is of from 6° to 30°.

23. A fuel injection pump as defined by claim 13, in which the axes of the control bores (20) intersect a line from the axis of the pump piston through an axis of an elliptical opening of the control bore along the inner wall (39) of the annular slide (11) in which a projection on the radial plane of the pump piston axis at an angle ($\alpha$) is from 6° to 30°.

24. A fuel injection pump as defined by claim 15, in which the axes of the control bores (20) intersect a line from the axis of the pump piston through an axis of an elliptical opening of the control bore along the inner wall (39) of the annular slide (11) in which a projection on the radial plane of the pump piston axis at an angle ($\alpha$) is of from 6° to 30°.

25. A fuel injection pump as defined by claim 3, in which the axes of the control bores (20) intersect the reference plane (35) in the projection on the radial plane of the pump piston axis preferably at an angle (gamma) of from 6° to 30°.

26. A fuel injection pump as defined by claim 5, in which the axes of the control bores (20) intersect the reference plane (35) in the projection on the radial plane of the pump piston axis preferably at an angle (gamma) of from 6° to 30°.

27. A fuel injection pump as defined by claim 7, in which the axes of the control bores (20) intersect the reference plane (35) in the projection on the radial plane of the pump piston axis preferably at an angle (gamma) of from 6° to 30°.

28. A fuel injection pump as defined by claim 9, in which the axes of the control bores (20) intersect the reference plane (35) in the projection on the radial plane of the pump piston axis preferably at an angle (gamma) of from 6° to 30°.

* * * * *